US008408336B2

(12) United States Patent
Hall et al.

(10) Patent No.: US 8,408,336 B2
(45) Date of Patent: Apr. 2, 2013

(54) FLOW GUIDE ACTUATION

(75) Inventors: David R. Hall, Provo, UT (US); Scott Dahlgren, Alpine, UT (US); Paula Turner, Pleasant Grove, UT (US); Christopher Durrand, Pleasant Grove, UT (US); Jonathan Marshall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 359 days.

(21) Appl. No.: 12/473,444

(22) Filed: May 28, 2009

(65) Prior Publication Data

US 2009/0229883 A1 Sep. 17, 2009

Related U.S. Application Data

(63) Continuation-in-part of application No. 12/262,372, filed on Oct. 31, 2008, now Pat. No. 7,730,972, which is a continuation-in-part of application No. 12/178,467, filed on Jul. 23, 2008, now Pat. No. 7,730,975, which is a continuation-in-part of (Continued)

(51) Int. Cl.
*E21B 4/02* (2006.01)

(52) U.S. Cl. ..... 175/107; 175/324; 415/157; 415/160

(58) Field of Classification Search ..... 175/57, 175/107, 324; 367/83–85; 415/156, 157, 415/160

See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kuhne |
| 923,513 | A | 6/1909 | Hardsocg |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,258,418 | A | 3/1918 | Kemble |
| 1,360,908 | A | 11/1920 | Everson |
| 1,372,257 | A | 3/1921 | Swisher |
| 1,387,733 | A | 8/1921 | Midgett |
| 1,460,671 | A | 7/1923 | Hebsacker |
| 1,544,757 | A | 7/1925 | Hufford |
| 1,712,948 | A | 5/1929 | Burch |

(Continued)

OTHER PUBLICATIONS

International Preliminary Report on Patentability and Written Opinion of the International Searching Authority for PCT/US06/43125, date of mailing Jun. 4, 2007; and the International Search Report, dated Feb. 23, 2007.

(Continued)

*Primary Examiner* — Giovanna Wright
*Assistant Examiner* — Richard Alker
(74) *Attorney, Agent, or Firm* — Brinks Hofer Gilson & Lione

(57) ABSTRACT

In one aspect of the present invention, a downhole drill string assembly comprises a bore there through to receive drilling fluid. A turbine may be disposed within the bore and exposed to the drilling fluid. At least one flow guide may be disposed within the bore and exposed to the drilling fluid wherein the flow guide acts to redirect the flow of the drilling fluid across the turbine. The flow guide may be adjusted by an actuator. Adjustments to the flow guide may be controlled by a downhole telemetry system, a processing unit, a control loop, or any combination thereof. In various embodiments the turbine may comprise rotatable turbine blades.

17 Claims, 13 Drawing Sheets

Related U.S. Application Data application No. 12/039,608, filed on Feb. 28, 2008, now Pat. No. 7,762,353, which is a continuation-in-part of application No. 12/037,682, filed on Feb. 26, 2008, now Pat. No. 7,624,824, which is a continuation-in-part of application No. 12/019,782, filed on Jan. 25, 2008, now Pat. No. 7,617,886, which is a continuation-in-part of application No. 11/837,321, filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, application No. 12/473,444, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196, application No. 12/473,444, which is a continuation-in-part of application No. 11/555,334, filed on Nov. 1, 2006, now Pat. No. 7,419,018.

(56) References Cited

U.S. PATENT DOCUMENTS

| | | | | |
|---|---|---|---|---|
| 1,746,455 | A | | 2/1930 | Woodruff et al. |
| 1,746,456 | A | | 2/1930 | Allington |
| 1,821,474 | A | | 9/1931 | Mercer |
| 1,836,638 | A | | 12/1931 | Wright et al. |
| 1,879,177 | A | | 9/1932 | Gault |
| 1,921,135 | A | | 8/1933 | Santiago |
| 2,054,255 | A | | 9/1936 | Howard |
| 2,064,255 | A | | 12/1936 | Garfield |
| 2,153,034 | A | | 4/1939 | Baker |
| 2,169,223 | A | | 8/1939 | Christian |
| 2,170,452 | A | | 8/1939 | Grant |
| 2,196,657 | A | | 4/1940 | Burt |
| 2,196,940 | A | | 4/1940 | Potts |
| 2,218,130 | A | | 10/1940 | Court |
| 2,227,233 | A | | 12/1940 | Scott et al. |
| 2,300,016 | A | | 10/1942 | Scott et al. |
| 2,320,136 | A | | 5/1943 | Kammerer |
| 2,320,670 | A | | 6/1943 | Scaramucci |
| 2,345,024 | A | | 3/1944 | Bannister |
| 2,371,248 | A | | 3/1945 | McNamara |
| 2,414,719 | A | | 1/1947 | Cloud |
| 2,427,052 | A | | 9/1947 | Grant |
| 2,466,991 | A | | 4/1949 | Kammerer |
| 2,498,192 | A | | 2/1950 | Wright |
| 2,540,464 | A | | 2/1951 | Stokes |
| 2,545,036 | A | | 3/1951 | Kammerer |
| 2,575,173 | A | | 11/1951 | Johnson |
| 2,615,519 | A | | 10/1952 | Carr |
| 2,619,325 | A | | 11/1952 | Arutunoff |
| 2,626,780 | A | | 1/1953 | Ortloff |
| 2,643,860 | A | | 6/1953 | Koch |
| 2,725,215 | A | | 11/1955 | MacNeir |
| 2,735,653 | A | | 2/1956 | Bielstein |
| 2,737,244 | A | | 3/1956 | Baker et al. |
| 2,755,071 | A | | 7/1956 | Kammerer |
| 2,776,819 | A | | 1/1957 | Brown |
| 2,805,818 | A | * | 9/1957 | Ferri ..... 415/148 |
| 2,819,041 | A | | 1/1958 | Beckham |
| 2,819,043 | A | | 1/1958 | Henderson |
| 2,838,284 | A | | 6/1958 | Austin |
| 2,854,211 | A | * | 9/1958 | Bendersky ..... 415/160 |
| 2,873,093 | A | | 2/1959 | Hildebrandt |
| 2,877,984 | A | | 3/1959 | Causey |
| 2,894,722 | A | | 7/1959 | Buttolph |
| 2,901,223 | A | | 8/1959 | Scott |
| 2,940,039 | A | | 6/1960 | Yost et al. |
| 2,942,850 | A | | 6/1960 | Heath |
| 2,963,102 | A | | 12/1960 | Smith |
| 2,998,085 | A | | 8/1961 | Dulaney |
| 3,001,584 | A | | 9/1961 | Scott |
| 3,036,645 | A | | 5/1962 | Rowley |
| 3,039,531 | A | | 6/1962 | Scott |
| 3,054,415 | A | | 9/1962 | Baker et al. |
| 3,055,443 | A | | 9/1962 | Edwards |
| 3,058,532 | A | | 10/1962 | Alder |
| 3,075,592 | A | | 1/1963 | Overly et al. |
| 3,077,936 | A | | 2/1963 | Arutunoff |
| 3,126,065 | A | | 3/1964 | Chadderdon |
| 3,130,783 | A | | 4/1964 | Orr |
| 3,135,341 | A | | 6/1964 | Ritter |
| 3,139,147 | A | | 6/1964 | Hays et al. |
| 3,163,243 | A | | 12/1964 | Cleary |
| 3,187,191 | A | | 6/1965 | Baggs |
| 3,216,514 | A | | 11/1965 | Nelson |
| 3,251,424 | A | | 5/1966 | Brooks |
| 3,294,186 | A | | 12/1966 | Buell |
| 3,301,339 | A | | 1/1967 | Pennebaker, Jr. |
| 3,303,899 | A | | 2/1967 | Jones, Jr. et al. |
| 3,336,988 | A | | 8/1967 | Jones, Jr. |
| 3,342,267 | A | | 9/1967 | Cotter et al. |
| 3,362,488 | A | * | 1/1968 | Ioanesyan et al. ..... 175/93 |
| 3,379,264 | A | | 4/1968 | Cox |
| 3,403,729 | A | | 10/1968 | Hickey |
| 3,429,390 | A | | 2/1969 | Bennett |
| 3,433,331 | A | | 3/1969 | Heyberger |
| 3,455,158 | A | | 7/1969 | Richter, Jr. et al. |
| 3,493,165 | A | | 2/1970 | Schonfeld |
| 3,583,504 | A | | 6/1971 | Aalund |
| 3,635,296 | A | | 1/1972 | Lebourg |
| 3,693,428 | A | * | 9/1972 | Le Peuvedic et al. ..... 367/85 |
| 3,700,049 | A | | 10/1972 | Tiraspolsky et al. |
| 3,703,104 | A | | 11/1972 | Tamplen |
| 3,732,143 | A | | 5/1973 | Joosse |
| 3,758,731 | A | | 9/1973 | Vann et al. |
| 3,765,493 | A | | 10/1973 | Rosar et al. |
| 3,807,512 | A | | 4/1974 | Pogonowski et al. |
| 3,815,692 | A | | 6/1974 | Varley |
| 3,821,993 | A | | 7/1974 | Kniff |
| 3,823,773 | A | | 7/1974 | Nutter |
| 3,867,655 | A | | 2/1975 | Stengel et al. |
| 3,899,033 | A | | 8/1975 | Van Huisen |
| 3,936,683 | A | | 2/1976 | Walker |
| 3,955,635 | A | | 5/1976 | Skidmore |
| 3,960,223 | A | | 6/1976 | Kleine |
| 3,967,201 | A | | 6/1976 | Rorden |
| 3,971,450 | A | * | 7/1976 | Fox ..... 175/107 |
| 3,978,931 | A | | 9/1976 | Sudnishnikov et al. |
| 3,986,554 | A | | 10/1976 | Nutter |
| 3,989,114 | A | * | 11/1976 | Tschirky et al. ..... 175/107 |
| 4,007,797 | A | | 2/1977 | Jeter |
| 4,015,234 | A | | 3/1977 | Krebs |
| 4,033,408 | A | | 7/1977 | Fredd et al. |
| 4,075,500 | A | * | 2/1978 | Oman et al. ..... 290/55 |
| 4,081,042 | A | | 3/1978 | Johnson et al. |

4,096,917 A 6/1978 Harris
4,106,577 A 8/1978 Summers
4,132,243 A 1/1979 Kuus
RE30,055 E 7/1979 Claycomb
4,165,790 A 8/1979 Emmerich
4,173,457 A 11/1979 Smith
4,176,723 A 12/1979 Arceneaux
4,207,485 A 6/1980 Silver
4,211,291 A 7/1980 Kellner
4,253,533 A 3/1981 Baker
4,262,758 A 4/1981 Evans
4,266,605 A 5/1981 LaBorde et al.
4,277,707 A 7/1981 Silver et al.
4,280,573 A 7/1981 Sudnishnikov
4,283,779 A 8/1981 Lamel
4,304,312 A 12/1981 Larsson
4,307,786 A 12/1981 Evans
4,386,669 A 6/1983 Evans
4,397,361 A 8/1983 Langford
4,416,339 A 11/1983 Baker et al.
4,416,494 A 11/1983 Watkins et al.
4,445,580 A 5/1984 Sahley
4,448,269 A 5/1984 Ishikawa
4,462,469 A 7/1984 Brown
4,478,296 A 10/1984 Richman, Jr.
4,491,187 A 1/1985 Russell
4,491,738 A 1/1985 Kamp
4,499,795 A 2/1985 Radtke
4,520,870 A 6/1985 Pringle
4,531,592 A 7/1985 Hayatdavoudi
4,532,614 A 7/1985 Peppers
4,535,853 A 8/1985 Ippolito
4,538,691 A 9/1985 Dennis
4,564,068 A 1/1986 Baugh
4,566,545 A 1/1986 Story
4,574,894 A 3/1986 Jadwin
4,574,895 A 3/1986 Dolezal
4,578,675 A 3/1986 MacLeod
4,583,592 A 4/1986 Gazda et al.
4,592,432 A 6/1986 Williams et al.
4,596,293 A 6/1986 Wallussek et al.
4,597,454 A 7/1986 Schoeffler
4,612,987 A 9/1986 Cheek
4,624,306 A 11/1986 Traver et al.
4,632,193 A * 12/1986 Geczy ..... 175/65
4,637,479 A 1/1987 Leising
4,640,374 A 2/1987 Dennis
4,655,289 A 4/1987 Schoeffler
4,676,310 A 6/1987 Scherbatskoy et al.
4,679,637 A 7/1987 Cherrington
4,683,781 A 8/1987 Kar et al.
4,720,640 A 1/1988 Anderson et al.
4,721,172 A 1/1988 Brett et al.
4,722,661 A 2/1988 Mizuno
4,732,223 A 3/1988 Schoeffler
4,732,225 A 3/1988 Jurgens et al.
4,754,181 A 6/1988 Mizobuchi et al.
4,775,017 A 10/1988 Forrest et al.
4,782,894 A 11/1988 LaFleur
4,785,247 A 11/1988 Meador et al.
4,788,544 A 11/1988 Howard
4,802,150 A 1/1989 Russell et al.
4,806,928 A 2/1989 Veneruso
4,819,745 A 4/1989 Walter
4,830,122 A 5/1989 Walter
4,836,301 A 6/1989 Van Dongen et al.
4,852,672 A 8/1989 Behrens
4,869,100 A 9/1989 Birdwell
4,889,017 A 12/1989 Fuller
4,889,199 A 12/1989 Lee
4,893,678 A 1/1990 Stokley et al.
4,895,214 A 1/1990 Schoeffler
4,907,665 A 3/1990 Kar et al.
4,924,949 A 5/1990 Curlett
4,928,520 A 5/1990 Barrington
4,962,822 A 10/1990 Pascale
4,965,998 A 10/1990 Estigoy et al.
4,974,688 A 12/1990 Helton
4,981,184 A 1/1991 Knowlton
4,991,667 A 2/1991 Wilkes et al.
5,009,273 A 4/1991 Grabinski
5,027,914 A 7/1991 Wilson
5,038,873 A 8/1991 Jurgens
5,052,503 A 10/1991 Lof
5,088,568 A 2/1992 Simuni
5,090,944 A 2/1992 Kyo et al.
5,094,304 A 3/1992 Briggs
5,098,258 A 3/1992 Barnetche-Gonzalez
5,103,919 A 4/1992 Warren et al.
5,112,188 A 5/1992 Barnetche-Gonzalez
5,119,892 A 6/1992 Clegg
5,135,060 A 8/1992 Ide
5,141,063 A 8/1992 Quesenbury
5,148,875 A 9/1992 Karlsson et al.
5,163,520 A 11/1992 Gibson et al.
5,176,212 A 1/1993 Tandberg
5,186,268 A 2/1993 Clegg
5,189,645 A 2/1993 Innes
5,222,566 A 6/1993 Taylor
5,230,390 A 7/1993 Zastresek et al.
5,232,058 A * 8/1993 Morin et al. ..... 175/73
5,248,896 A 9/1993 Forrest
5,255,749 A 10/1993 Bumpurs
5,259,469 A 11/1993 Stjernstrom
5,265,682 A 11/1993 Russell
5,270,600 A 12/1993 Hashimoto
5,311,953 A 5/1994 Walker
5,314,030 A 5/1994 Peterson et al.
5,316,094 A 5/1994 Pringle
5,337,002 A 8/1994 Mercer
5,361,859 A 11/1994 Tibbitts
5,388,649 A 2/1995 Ilomaki
5,392,862 A 2/1995 Swearingen
5,410,303 A 4/1995 Comeau
5,415,030 A 5/1995 Jogi et al.
5,417,292 A 5/1995 Polakoff
5,423,389 A 6/1995 Warren
5,475,309 A 12/1995 Hong et al.
5,499,687 A 3/1996 Lee
5,507,357 A 4/1996 Hult
5,517,464 A 5/1996 Lerner et al.
5,539,258 A 7/1996 Sutton et al.
5,553,678 A 9/1996 Barr et al.
5,560,440 A 10/1996 Tibbitts
5,568,838 A 10/1996 Struthers
5,584,342 A 12/1996 Swinford
5,609,178 A 3/1997 Hennig et al.
5,626,200 A 5/1997 Gilbert et al.
5,642,782 A 7/1997 Grimshaw
5,655,614 A 8/1997 Azar
5,673,763 A 10/1997 Thorp
5,678,644 A 10/1997 Fielder
5,685,379 A 11/1997 Barr et al.
5,695,015 A 12/1997 Barr et al.
5,706,905 A 1/1998 Barr
5,720,355 A 2/1998 Lamine et al.
5,730,222 A 3/1998 Rike, Jr.
5,732,784 A 3/1998 Nelson
5,758,731 A 6/1998 Zollinger
5,762,156 A 6/1998 Bates et al.
5,778,991 A 7/1998 Runquist et al.
5,794,728 A 8/1998 Palmberg
5,803,185 A 9/1998 Barr et al.
5,803,193 A 9/1998 Krueger et al.
5,806,611 A 9/1998 Van Den Steen
5,833,002 A 11/1998 Holcombe
5,833,021 A 11/1998 Mensa-Wilmot
5,839,508 A 11/1998 Tubel et al.
5,856,790 A 1/1999 Baugh et al.
5,864,058 A 1/1999 Chen
5,896,938 A 4/1999 Money
5,901,113 A 5/1999 Masak
5,904,444 A 5/1999 Kabeuchi et al.
5,924,499 A 7/1999 Birchak et al.
5,947,215 A 9/1999 Lundell
5,950,743 A 9/1999 Cox
5,957,223 A 9/1999 Doster
5,957,225 A 9/1999 Sinor 5,965,964 A 10/1999 Skinner et al.
5,967,247 A 10/1999 Pessier
5,979,571 A 11/1999 Scott et al.
5,992,547 A 11/1999 Caraway
5,992,548 A 11/1999 Silva
6,011,334 A 1/2000 Roland
6,021,859 A 2/2000 Tibbitts
6,030,004 A 2/2000 Schock et al.
6,039,131 A 3/2000 Beaton
6,047,239 A 4/2000 Berger et al.
6,050,350 A 4/2000 Morris et al.
6,089,332 A 7/2000 Barr et al.
6,092,610 A 7/2000 Kosmala et al.
6,123,561 A 9/2000 Turner et al.
6,131,675 A 10/2000 Anderson
6,142,250 A 11/2000 Griffin et al.
6,150,822 A 11/2000 Hong et al.
6,186,251 B1 2/2001 Butcher
6,202,761 B1 3/2001 Forney
6,213,225 B1 4/2001 Chen
6,213,226 B1 4/2001 Eppink
6,220,079 B1 4/2001 Taylor et al.
6,223,824 B1 5/2001 Moyes
6,223,826 B1 5/2001 Chau et al.
6,253,847 B1 7/2001 Stephenson
6,269,893 B1 8/2001 Beaton
6,296,069 B1 10/2001 Lamine et al.
6,298,930 B1 10/2001 Sinor
6,321,858 B1 11/2001 Wentworth et al.
6,340,064 B2 1/2002 Fielder
6,363,780 B1 4/2002 Rey-Fabret et al.
6,364,034 B1 4/2002 Schoeffler
6,364,038 B1 4/2002 Driver
6,367,564 B1 4/2002 Mills et al.
6,382,330 B2 5/2002 Bischel et al.
6,388,346 B1 5/2002 Lopatinsky et al.
6,390,200 B1 5/2002 Allamon et al.
6,392,317 B1 5/2002 Hall et al.
6,394,200 B1 5/2002 Watson
6,419,014 B1 7/2002 Meek et al.
6,431,270 B1 8/2002 Angle
6,439,326 B1 8/2002 Huang et al.
6,443,249 B2 9/2002 Beuershausen
6,446,728 B2 9/2002 Chau et al.
6,450,269 B1 9/2002 Wentworth
6,454,030 B1 9/2002 Findley et al.
6,466,513 B1 10/2002 Pabon et al.
6,467,341 B1 10/2002 Boucher et al.
6,474,425 B1 11/2002 Truax
6,484,819 B1 11/2002 Harrison
6,484,825 B2 11/2002 Watson
6,495,929 B2 12/2002 Bosley et al.
6,510,906 B1 1/2003 Richert
6,513,606 B1 2/2003 Krueger
6,533,050 B2 3/2003 Molloy
6,550,534 B2 4/2003 Brett
6,561,289 B2 5/2003 Portman et al.
6,571,888 B2 6/2003 Comeau et al.
6,575,236 B1 6/2003 Heinjen
6,581,699 B1 6/2003 Chen et al.
6,588,518 B2 7/2003 Eddison
6,594,881 B2 7/2003 Tibbitts
6,601,454 B1 8/2003 Botnan
6,619,388 B2 9/2003 Dietz et al.
6,622,803 B2 9/2003 Harvey
6,634,388 B1 10/2003 Taylor et al.
6,651,755 B1 11/2003 Kelpe
6,655,464 B2 12/2003 Chau et al.
6,668,949 B1 12/2003 Rives
6,670,880 B1 12/2003 Hall et al.
6,672,409 B1 1/2004 Dock et al.
6,688,396 B2 2/2004 Floerke et al.
6,712,159 B2 * 3/2004 Estes et al. ..... 175/40
6,717,283 B2 4/2004 Skinner et al.
6,717,501 B2 4/2004 Hall et al.
6,729,420 B2 5/2004 Mensa-Wilmot et al.
6,732,817 B2 5/2004 Dewey
6,739,413 B2 5/2004 Sharp et al.
6,745,844 B2 6/2004 Henderson
6,749,031 B2 6/2004 Klemm
6,776,240 B2 8/2004 Kenison et al.
6,789,635 B2 9/2004 Wentworth et al.
6,794,777 B1 9/2004 Fradella
6,799,632 B2 10/2004 Hall et al.
6,814,162 B2 11/2004 Moran et al.
6,821,147 B1 11/2004 Hall et al.
6,822,579 B2 11/2004 Goswami
6,830,467 B2 12/2004 Hall et al.
6,844,498 B2 1/2005 Hall et al.
6,845,822 B2 1/2005 Chau
6,848,503 B2 2/2005 Schultz et al.
6,854,953 B2 2/2005 Van Drentham-Susman et al.
6,863,124 B2 3/2005 Araux et al.
6,880,648 B2 4/2005 Edscer
6,888,473 B1 5/2005 Hall et al.
6,913,093 B2 7/2005 Hall et al.
6,913,095 B2 7/2005 Krueger
6,920,930 B2 7/2005 Allamon et al.
6,929,076 B2 8/2005 Fanuel et al.
6,929,493 B2 8/2005 Hall et al.
6,945,802 B2 9/2005 Hall et al.
6,948,572 B2 9/2005 Hay et al.
6,953,096 B2 10/2005 Gledhill
6,968,611 B2 11/2005 Hall et al.
6,994,175 B2 2/2006 Egerstrom
7,013,994 B2 3/2006 Eddison
7,028,779 B2 4/2006 Chau
7,036,611 B2 5/2006 Radford et al.
7,048,078 B2 5/2006 Dewey et al.
7,073,610 B2 7/2006 Susman
7,096,980 B2 8/2006 Trevas
7,133,325 B2 11/2006 Kotsonis et al.
7,150,329 B2 12/2006 Chau
7,165,608 B2 1/2007 Schultz et al.
7,190,084 B2 3/2007 Hall et al.
7,193,526 B2 3/2007 Hall et al.
7,198,119 B1 4/2007 Hall et al.
7,201,239 B1 4/2007 Perry
7,219,747 B2 5/2007 Gleitman et al.
7,225,886 B1 6/2007 Hall
7,246,660 B2 7/2007 Fripp et al.
7,261,184 B2 8/2007 Bass et al.
7,270,196 B2 9/2007 Hall
7,308,937 B2 12/2007 Radford et al.
7,328,755 B2 2/2008 Hall et al.
7,331,397 B1 2/2008 Wagley et al.
7,337,858 B2 3/2008 Hall et al.
7,360,610 B2 4/2008 Hall et al.
7,367,397 B2 5/2008 Clemens et al.
7,398,837 B2 7/2008 Hall et al.
7,419,016 B2 9/2008 Hall et al.
7,419,018 B2 9/2008 Hall
7,424,922 B2 9/2008 Hall et al.
7,426,968 B2 9/2008 Hall et al.
7,481,281 B2 1/2009 Schuaf
7,484,576 B2 2/2009 Hall et al.
7,497,279 B2 3/2009 Hall et al.
7,503,405 B2 3/2009 Hall et al.
7,506,701 B2 3/2009 Hall et al.
7,510,031 B2 3/2009 Russell et al.
7,549,489 B2 6/2009 Hall et al.
7,559,379 B2 7/2009 Hall et al.
7,600,586 B2 10/2009 Hall et al.
7,617,886 B2 11/2009 Hall et al.
7,624,824 B2 12/2009 Hall et al.
7,637,323 B2 12/2009 Schasteen et al.
7,641,003 B2 1/2010 Hall et al.
2001/0054515 A1 12/2001 Eddison et al.
2002/0050359 A1 5/2002 Eddison
2002/0135179 A1 9/2002 Boyle et al.
2002/0162654 A1 11/2002 Bauer et al.
2003/0042812 A1 3/2003 Post
2003/0116969 A1 6/2003 Skinner et al.
2003/0192449 A1 10/2003 Fiske et al.
2003/0213598 A1 11/2003 Hughes
2003/0213621 A1 11/2003 Britten
2004/0096316 A1 * 5/2004 Simon et al. ..... 415/151
2004/0104797 A1 6/2004 Hall et al.

2004/0113808 A1 6/2004 Hall et al.
2004/0145492 A1 7/2004 Hall et al.
2004/0150532 A1 8/2004 Hall et al.
2004/0164833 A1 8/2004 Hall et al.
2004/0164838 A1 8/2004 Hall et al.
2004/0173381 A1 9/2004 Moore et al.
2004/0182366 A1 9/2004 Andersson et al.
2004/0216847 A1 11/2004 Hall et al.
2004/0222024 A1 11/2004 Edscer
2004/0238221 A1 12/2004 Runia
2004/0244916 A1 12/2004 Hall et al.
2004/0244964 A1 12/2004 Hall et al.
2004/0246142 A1 12/2004 Hall et al.
2004/0256153 A1 12/2004 Helms et al.
2004/0256155 A1 12/2004 Kriesels
2005/0001735 A1 1/2005 Hall et al.
2005/0001736 A1 1/2005 Hall et al.
2005/0001738 A1 1/2005 Hall et al.
2005/0011678 A1 1/2005 Akinlade et al.
2005/0024231 A1 2/2005 Fincher et al.
2005/0035874 A1 2/2005 Hall et al.
2005/0035875 A1 2/2005 Hall et al.
2005/0035876 A1 2/2005 Hall et al.
2005/0036507 A1 2/2005 Hall et al.
2005/0039912 A1 2/2005 Hall et al.
2005/0045339 A1 3/2005 Hall et al.
2005/0046586 A1 3/2005 Hall et al.
2005/0046590 A1 3/2005 Hall et al.
2005/0067159 A1 3/2005 Hall et al.
2005/0070144 A1 3/2005 Hall et al.
2005/0082092 A1 4/2005 Hall et al.
2005/0092499 A1 5/2005 Hall et al.
2005/0093296 A1 5/2005 Hall et al.
2005/0095827 A1 5/2005 Hall et al.
2005/0115717 A1 6/2005 Hall et al.
2005/0115718 A1 6/2005 Symons et al.
2005/0139393 A1 6/2005 Maurer et al.
2005/0145406 A1 7/2005 Hall et al.
2005/0145417 A1 7/2005 Radford et al.
2005/0150653 A1 7/2005 Hall et al.
2005/0155450 A1 7/2005 Jennings
2005/0161215 A1 7/2005 Hall et al.
2005/0173128 A1 8/2005 Hall et al.
2005/0211471 A1* 9/2005 Zupanick ..... 175/57
2005/0212530 A1 9/2005 Hall et al.
2005/0236160 A1 10/2005 Hall et al.
2005/0284662 A1 12/2005 Hall et al.
2006/0016606 A1 1/2006 Tubel et al.
2006/0034154 A1 2/2006 Perry et al.
2006/0117759 A1 6/2006 Hall et al.
2006/0243455 A1 11/2006 Telfer et al.
2006/0243493 A1 11/2006 El-Rayes et al.
2006/0260797 A1 11/2006 Hall et al.
2006/0260798 A1 11/2006 Hall et al.
2006/0260801 A1 11/2006 Hall et al.
2007/0017671 A1 1/2007 Clark et al.
2007/0017679 A1 1/2007 Wolf et al.
2007/0056724 A1 3/2007 Spring et al.
2007/0062706 A1 3/2007 Leising
2007/0079988 A1 4/2007 Konschuh et al.
2007/0107944 A1 5/2007 Lee
2007/0194948 A1 8/2007 Hall et al.
2007/0242565 A1 10/2007 Hall et al.
2007/0251696 A1 11/2007 Parks
2008/0041597 A1 2/2008 Fisher et al.
2008/0105464 A1 5/2008 Radford
2008/0217024 A1 9/2008 Moore
2008/0296015 A1 12/2008 Hall et al.
2009/0044951 A1 2/2009 Milkovisch et al.
2009/0056497 A1 3/2009 Swinford
2009/0126936 A1 5/2009 Begley et al.
2009/0166086 A1 7/2009 Sugiura
2010/0132954 A1 6/2010 Telfer
2011/0120725 A1* 5/2011 Downton et al. ..... 166/373
2011/0278017 A1 11/2011 Themig et al.

OTHER PUBLICATIONS

International Preliminary Report on Patentability, International Search Report and Written Opinion of the International Searching Authority for PCT/US06/43107, date of mailing Mar. 5, 2007.

International Search Report and Written Opinion for PCT/US07/64544, date of mailing Aug. 5, 2008.

* cited by examiner

FLOW GUIDE ACTUATION

CROSS REFERENCE TO RELATED APPLICATIONS

This patent application is a continuation-in-part of U.S. patent application Ser. No. 12/262,372 filed on Oct. 31, 2008 and which is now U.S. Pat. No. 7,730,972 issued on Jun. 8, 2010, which is a continuation-in-part of U.S. patent application Ser. No. 12/178,467 filed on Jul. 23, 2008 and which is now U.S. Pat. No. 7,730,975 issued on Jun. 8, 2010, which is a continuation-in-part of U.S. patent application Ser. No. 12/039,608 filed on Feb. 28, 2008 and which is now U.S. Pat. No. 7,762,353 issued on Jul. 27, 2010, which is a continuation-in-part of U.S. patent application Ser. No. 12/037,682 filed on Feb. 26, 2008 and which is now U.S. Pat. No. 7,624,824 issued on Dec. 1, 2009, which is a continuation-in-part of U.S. patent application Ser. No. 12/019,782 filed on January 25, 2008 and which is now U.S. Pat. No. 7,617,886, which is a continuation-in-part of U.S. patent application Ser. No. 11/837,321 filed on Aug. 10, 2007 and which is now U.S. Pat. 7,559,379, which is a continuation-in-part of U.S. patent application Ser. No. 11/750,700 filed on May 18, 2007 and which is now U.S. Pat. No. 7,549,489 issued on Jun. 23, 2009, which is a continuation-in-part of U.S. patent application Ser. No. 11/737,034 filed on Apr. 18, 2007 and which is now U.S. Pat. No. 7,503,405 issued on Mar. 17, 2009, which is a continuation-in-part of U.S. patent application Ser. No. 11/686,638 filed on Mar. 15, 2007 and which is now U.S. Pat. No. 7,424,922 issued on Sep. 16, 2008, which is a continuation-in-part of U.S. patent application Ser. No. 11/680,997 filed on Mar. 1, 2007 and which is now U.S. Pat. No. 7,419,016 issued on Sep. 2, 2008, which is a continuation-in-part of U.S. patent application Ser. No. 11/673,872 filed on Feb. 12, 2007 and which is now U.S. Pat. No. 7,484,576 issued on Feb. 3, 2009, which is a continuation-in-part of U.S. patent application Ser. No. 11/611,310 filed on Dec. 15, 2006 and which is now U.S. Pat. No. 7,600,586 issued on Oct. 13, 2009.

This patent application is also a continuation-in-part of U.S. patent application Ser. No. 11/278,935 filed on Apr. 6, 2006 and which is now U.S. Pat. No. 7,426,968 issued on Sep. 23, 2008, which is a continuation-in-part of U.S. patent application Ser. No. 11/277,394 filed on Mar. 24, 2006 and which is now U.S. Pat. No. 7,398,837 issued on Jul. 15, 2008, which is a continuation-in-part of U.S. patent application Ser. No. 11/277,380 filed on Mar. 24, 2006 and which is now U.S. Pat. No. 7,337,858 issued on Mar. 4, 2008, which is a continuation-in-part of U.S. patent application Ser. No. 11/306,976 filed on Jan. 18, 2006 and which is now U.S. Pat. No. 7,360,610 issued on Apr. 22, 2008, which is a continuation-in-part of U.S. patent application Ser. No. 11/306,307 filed on Dec. 22, 2005 and which is now U.S. Pat. No. 7,225,886 issued on Jun. 5, 2007, which is a continuation-in-part of U.S. patent application Ser. No. 11/306,022 filed on Dec. 14, 2005 and which is now U.S. Pat. No. 7,198,119 issued on Apr. 3, 2007, which is a continuation-in-part of U.S. patent application Ser. No. 11/164,391 filed on Nov. 21, 2005 and which is now U.S. Pat. No. 7,270,196 issued on Sep. 18, 2007.

This patent application is also a continuation-in-part of U.S. patent application Ser. No. 11/555,334 filed on Nov. 1, 2006 and which is now U.S. Pat. No. 7,419,018 issued on Sep. 2, 2008. All of these applications are herein incorporated by reference in their entirety.

BACKGROUND

This invention relates to the field of downhole turbines used in drilling. More specifically, the invention relates to controlling the rotational velocity of downhole turbines.

Previous attempts at controlling downhole turbine speed were performed by diverting a portion of the drilling fluid away from the turbine. It was believed that the diversion of drilling fluid away from the turbine results in less torque on the turbine itself. However, this technique may also require the additional expense of having to over design the turbine to ensure that sufficient torque is delivered when fluid flow is restricted.

U.S. Pat. No. 5,626,200 to Gilbert et al., which is herein incorporated by reference for all that it contains, discloses a logging-while-drilling tool for use in a wellbore in which a well fluid is circulated into the wellbore through a hollow drill string. In addition to measurement electronics, the tool includes an alternator for providing power to the electronics, and a turbine for driving the alternator. The turbine blades are driven by the well fluid introduced into the hollow drill string. The tool also includes a deflector to deflect a portion of the well fluid away from the turbine blades.

U.S. Patent No. 5,839,508 to Tubel et al., which is herein incorporated by reference for all that it contains, discloses an electrical generating apparatus which connects to the production tubing. In a preferred embodiment, this apparatus includes a housing having a primary flow passageway in communication with the production tubing. The housing also includes a laterally displaced side passageway communicating with the primary flow passageway such that production fluid passes upwardly towards the surface through the primary and side passageways. A flow diverter may be positioned in the housing to divert a variable amount of the production fluid from the production tubing and into the side passageway. In accordance with an important feature of this invention, an electrical generator is located at least partially in or along the side passageway. The electrical generator generates electricity through the interaction of the flowing production fluid.

U.S. Pat. No. 4,211,291 to Kellner, which is herein incorporated by reference for all it contains, discloses a drill fluid powered hydraulic system used for driving a shaft connected to a drill bit. The apparatus includes a hydraulic fluid powered motor actuated and controlled by hydraulic fluid. The hydraulic fluid is supplied to the hydraulic fluid powered motor through an intermediate drive system actuated by drill fluid. The intermediate drive system is provided with two rotary valves and two double sided accumulators. One of the rotary valves routes the hydraulic fluid to and from the accumulators from the drill fluid supply and from the accumulators to the drill bit. The rotary valves are indexed by a gear system and Geneva drive connected to the motor or drill shaft. A heat exchanger is provided to cool the hydraulic fluid. The heat exchanger has one side of the exchange piped between the drill fluid inlet and the drill fluid rotary valve and the other side of the exchange piped between the hydraulic fluid side of the accumulators and the hydraulic fluid rotary valve.

U.S. Pat. No. 4,462,469 to Brown, which is herein incorporated by reference for all that it contains, discloses a motor for driving a rotary drilling bit within a well through which mud is circulated during a drilling operation, with the motor being driven by a secondary fluid which is isolated from the circulating mud but derives energy therefrom to power the motor. A pressure drop in the circulating mud across a choke in the drill string is utilized to cause motion of the secondary fluid through the motor. An instrument which is within the well and develops data to be transmitted to the surface of the earth controls the actuation of the motor between different operation conditions in correspondence with data signals produced by the instrument, and the resulting variations in torque in the drill string and/or the variations in torque in the drill string and/or the variations in circulating fluid pressure are sensed at the surface of the earth to control and produce a readout representative of the down hole data.

U.S. Pat. No. 5,098,258 to Barnetche-Gonzalez, which is herein incorporated by reference for all that it contains, discloses a multistage drag turbine assembly provided for use in a downhole motor, the drag turbine assembly comprising an outer sleeve and a central shaft positioned within the outer sleeve, the central shaft having a hollow center and a divider means extending longitudinally in the hollow center for forming first and second longitudinal channels therein. A stator is mounted on the shaft. The stator has a hub surrounding the shaft and a seal member fixed to the hub wherein the hub and the shaft each have first and second slot openings therein. A rotor comprising a rotor rim and a plurality of turbine blades mounted on the rotor rim is positioned within the outer sleeve for rotation therewith respect to the stator such that a flow channel is formed in the outer sleeve between the turbine blades and the stator. A flow path is formed in the turbine assembly such that fluid flows though the turbine assembly, flows through the first longitudinal channel in the central shaft, through the first slot openings in the shaft and the stator hub, through the flow channel wherein the fluid contacts the edges of the turbine blades for causing a drag force thereon, and then through the second slot openings in the stator hub and the shaft into the second channel.

BRIEF SUMMARY

In one aspect of the present invention, a downhole drill string assembly has a bore formed there through formed to accept drilling fluid. The assembly also includes a turbine disposed within the bore. The turbine has at least one turbine blade and is in communication with a generator, a gear box, a steering assembly, a hammer element, a pulse telemetry device or any combination thereof.

The downhole drill string assembly further includes at least one flow guide disposed within the bore. The flow guide may be controlled by a feedback loop. The at least one flow guide may include a fin, an adjustable vane, a flexible surface, a pivot point or any combination thereof. The flow guide may be in communication with an actuator. The actuator may be a rack and pinion, a solenoid valve, an aspirator, a hydraulic piston, a flange, a spring, a pump, a motor, a plate, at least one gear, or a combination thereof.

In another aspect of embodiments of the present invention, a method for adjusting the rotation of a turbine is disclosed. This method comprises the steps of providing a downhole drill string assembly having a bore there through to receive drilling fluid, a turbine disposed within the bore and exposed to the drilling fluid, and at least one flow guide disposed within the bore and exposed to the drilling fluid. Then adjusting the flow guide to alter the flow of the drilling fluid, wherein the altered flow of the drilling fluid adjusts the rotation of the turbine.

The adjustment of the rotation of the turbine may comprise slowing down or speeding up of the rotational velocity of the turbine, or increasing or decreasing the rotational torque of the turbine. The adjustments may be controlled by a downhole telemetry system, a processing unit, a control loop, or any combination of the previous. The control loop may control the voltage output from a generator, a rotational velocity of the turbine, or a rotational torque from the turbine. The gain values of the control loop may be adjustable by an uphole computer and fed down to the turbine by a telemetry system or may be autonomously generated by prior programming against a preset target.

The assembly may further include a hammer disposed within the drill string and mechanically coupled to the turbine, wherein an actuation of the hammer is changed by adjusting the rotation of the turbine. The change in the actuation of the hammer may take the form of a change in frequency. This change in actuation may allow the hammer to be used to communicate uphole. The actuating hammer may be able to communicate through acoustic waves, vibrations of the drill string assembly, or changes in pressure created by the hammer impacting the formation or by the hammer impacting a surface within the drill string assembly. The turbine itself may also create a pressure pulse for use in communication or the turbine may actuate a valve to create a pressure pulse for use in communication.

DETAILED DESCRIPTION

Figure 1:
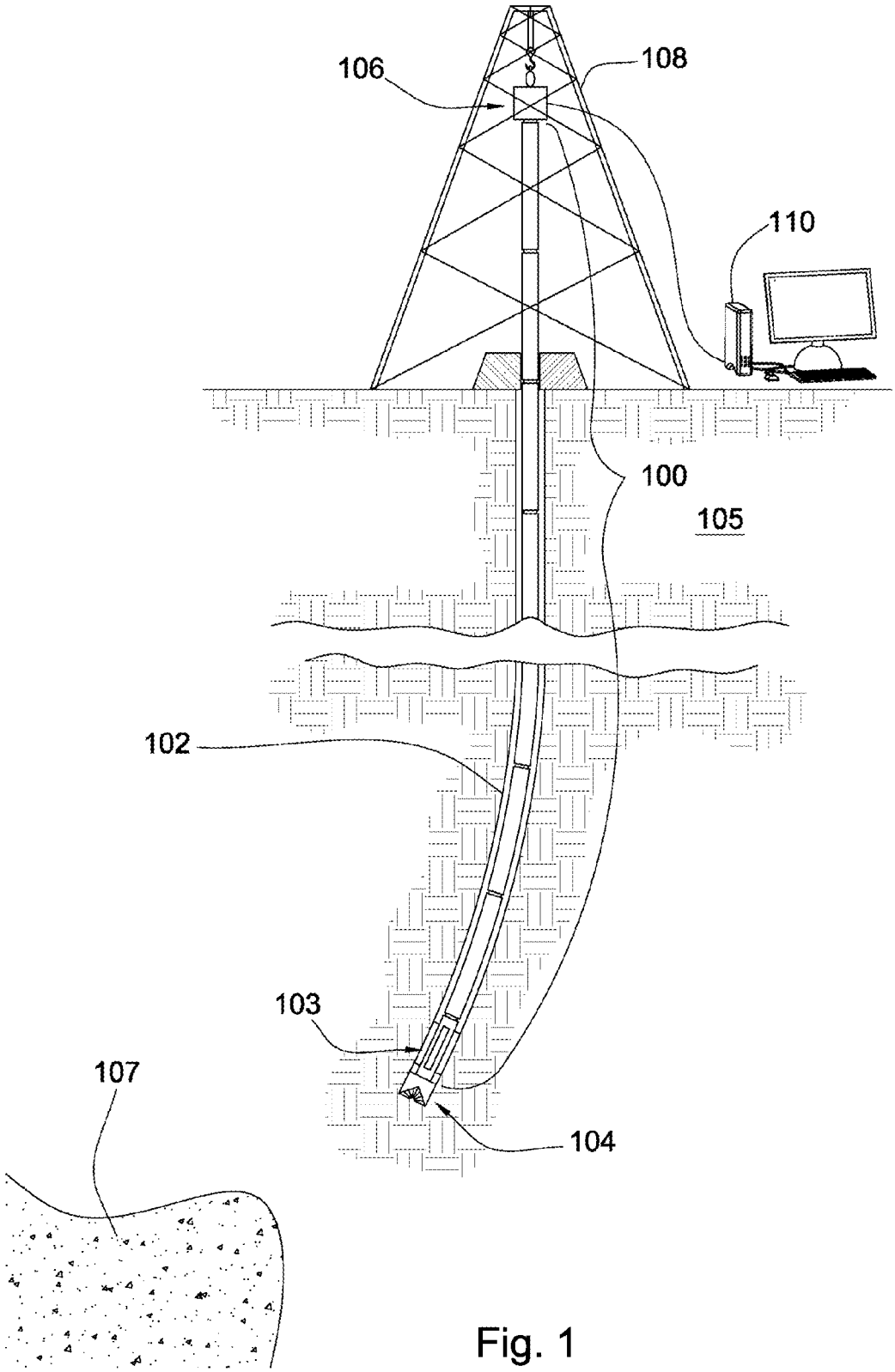
FIG. 1 is orthogonal diagram of an embodiment of a drill string assembly suspended in a cross section of a bore hole.

FIG. 1 is an orthogonal diagram of an embodiment of a drill string 100 suspended by a derrick 108 in a bore hole 102. A downhole drill string component having a drilling assembly 103 is located at a bottom of the bore hole 102 and includes a drill bit 104. As the drill bit 104 rotates downhole, the drill string 100 advances farther into a subterranean formations 105 having the bore hole 102. The drilling assembly 103 and/or downhole components may have data acquisition devices adapted to gather data that may be used identify a desirable formation 107 and to aid the drill string 100 in accessing the desirable formation 107. The data may be sent to the surface via a transmission system to a data swivel 106. The data swivel 106 may send data and/or power to the drill string 100. U.S. Pat. No. 6,670,880 to Hall et al. which is herein incorporated by reference for all that it contains, discloses a telemetry system that may be compatible with the present invention; however, other forms of telemetry may also be compatible such as systems that include mud pulse systems, electromagnetic waves, radio waves, wired pipe, and/or short hop. The data swivel 106 may be connected to a processing unit 110 and/or additional surface equipment.

Figure 2:
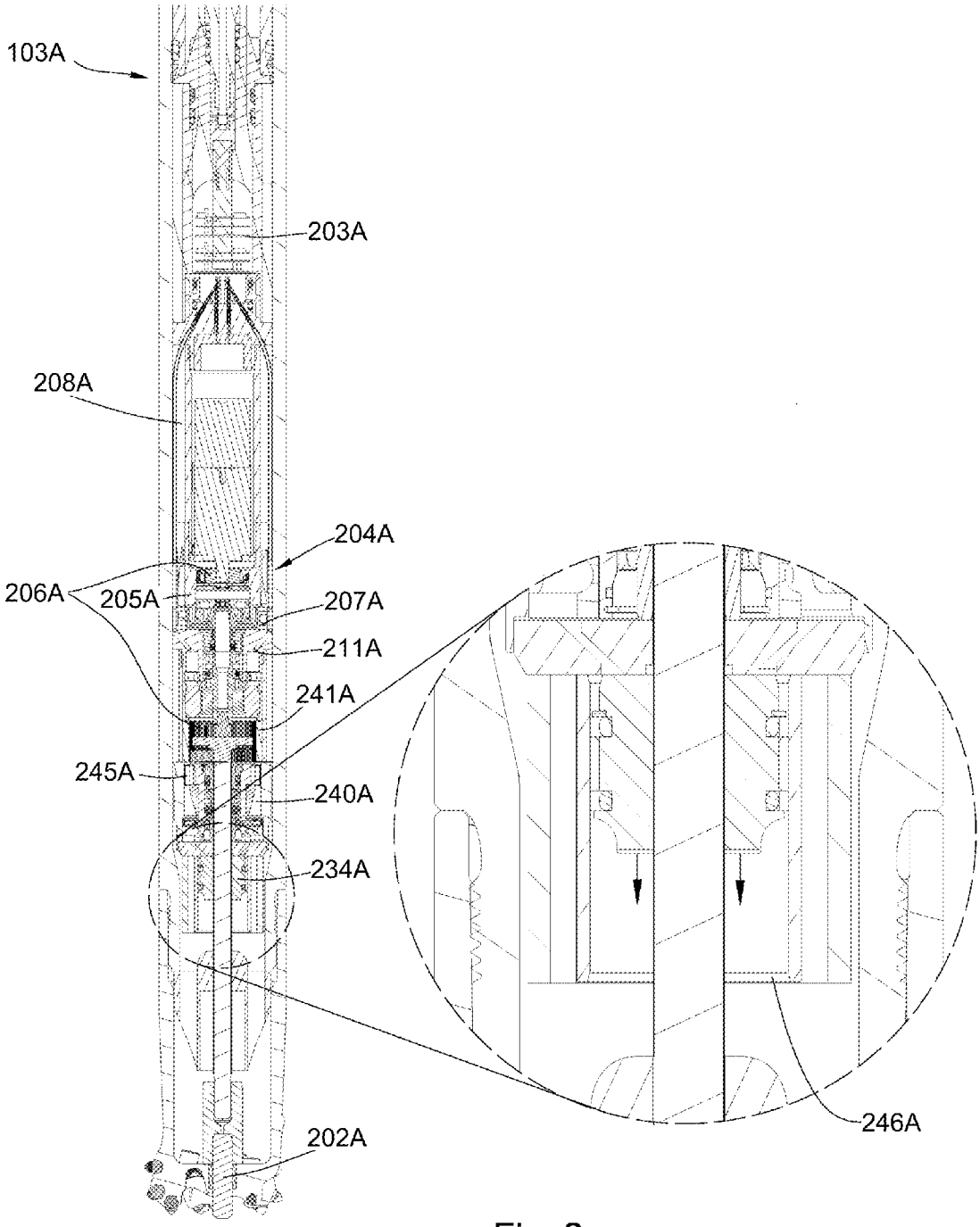
FIG. 2 is a cross-sectional diagram of an embodiment of a drill string assembly.

Referring now to FIG. 2, a drilling assembly 103A compatible with drill string 100 is illustrated. The drilling assembly 103A may have a jack element 202A. The jack element 202A aids in formation penetration and in steering the drill string. A first turbine 207A and a second turbine 240A may be located within a bore 208A formed in the drilling assembly 103A. The first turbine 207A or the second turbine 240A may be adapted for a variety of purposes including, but not limited to power generation, jack element actuation, steering, or hammer actuation.

In the embodiment of FIG. 2 the first turbine 207A is adapted to rotate the jack element 202A and the second turbine 240A is adapted to actuate a hammer element 234A. A gearbox 211A disposed in the bore 208A is adapted to transfer torque from the first turbine 207A to the jack element 202A. The rotational speed of the first turbine 207A is adjustable such that the rotational speed of the jack element 202A changes. The rotational speed of the second turbine 240A is adjustable such that the actuation of the hammer element 234A changes. A downhole processing unit 203A disposed within the bore 208A is in communication with a first actuator 204A and a second actuator 241A. In the embodiment of FIG. 2, the actuators 203A, 241A includes planetary gear systems 206A. The first actuator 204A is in further communication with a first at least one flow guide 205A, and the second actuator 241A is in turn in communication with a second at least one flow guide 245A. The downhole processing unit 203A controls the actuators 204A, 245A independently such that the first at least one flow guides 205A and the second at least one flow guide 245A, are manipulated causing the first turbine 207A and the second turbine 240A to change speeds independently.

Adjusting the second at least one flow guide 245A causes the second turbine 240A to change rotational speed thereby causing the frequency of the actuation of the hammer element 234A to change. Through the changing of the frequency of the actuation of the hammer element 234, uphole communication is possible. The communication signals may take the form of the hammer element 234A creating acoustic waves from an impact of the hammer element 234A on the formation, or the impact of the hammer element 234A on a surface 246A within the drill string assembly 103A. The communication signals may also take the form of a vibration of the tool string assembly 103A or pressure changes of a drilling fluid within the tool string assembly 103A caused by the hammer element's 234A actuation. An uphole sensor such as a geophone, a pressure sensor, or an acoustic sensor may be used to receive the communications uphole. Communication along the drill string may also take the form of pressure pulses created by changing the rotational speed of the first turbine 207A and/or the second turbine 240A, or by rotating a valve with the first turbine 207A of the second turbine 240A.

The processing unit 203A may also be in communication with a downhole telemetry system, such that an uphole operator can send commands to the first actuator 204A and the second actuator 241A. The processing unit 203A may also have a feedback loop that controls the actuator 204A. The feedback loop may be controlled by an output of the first turbine 207A and/or the second turbine 240A. The controlling output of the first turbine 207A and/or the second turbine 240A may include a voltage output from a generator (not shown) that is powered by the first turbine 207A or the second turbine 240A respectively, a desired rotational velocity of first turbine 207A or the second turbine 240A respectively, or a desired rotational torque of the first turbine 207A or the second turbine 240A respectively. The controlling gains of the feedback loop and other aspects of the feedback loop may be adjustable by an uphole computer.

Figure 3:
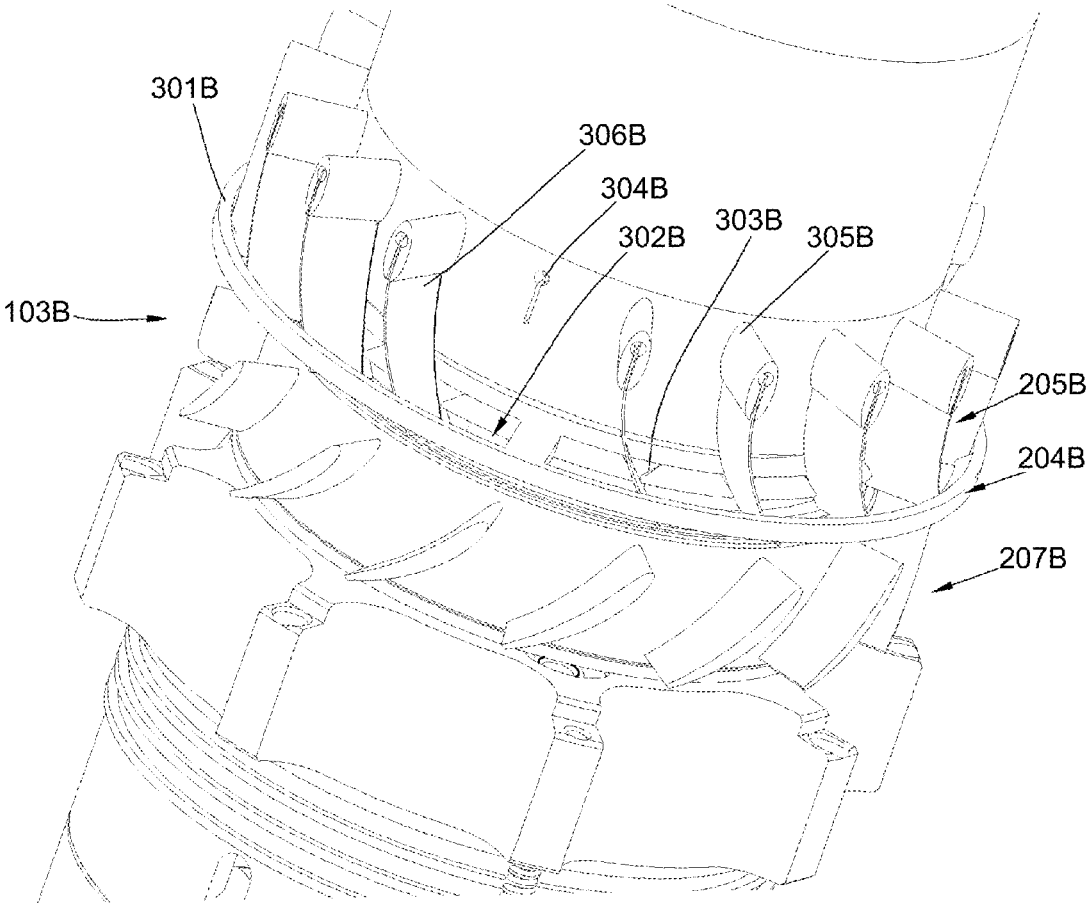
FIG. 3 is a perspective diagram of an embodiment of a turbine, flow guide, and actuator.

FIG. 3 is a perspective diagram of a portion of an embodiment of a drilling assembly 103B. In this figure a turbine 207B, an actuator 204B and at least one flow guide 205B are depicted. The actuator 204B in this embodiment is a plate 301B. The plate 301B is disposed axially around the drilling assembly 103B. The plate 301B includes pass through slots 302B adapted to allow fluid to flow through the plate 301B. The plate 301B includes attachment points 303B adapted to attach to at least one flow guide 205B. The at least one flow guide 205B has a clamp 305B. The clamp 305B is be adapted to attach to the drill assembly 103B through a connection point 304B. The flow guide 205B includes a flexible vane 306B.

As drilling fluid travels down the drill string and enters into the drilling assembly 103B the turbine 207B may begin to rotate. The rotational force generated by the turbine 207B may be used for a variety of applications including but not limited to generating power or actuating devices downhole. It may be beneficial to control the rotational speed of the turbine 207B to better meet requirements at a given time.

The plate 301B may be part of an actuator 204B such as a gear system or motor that actuates rotational movement. Alternatively, the plate 301B may hold the flow guide 205B stationary. A downhole processing unit disposed within the drill string (see FIG. 2) or surface processing unit (see FIG. 1) may be in communication with the plate 301B through the actuator 204B. Rotating the plate 301B may cause the vanes 306B to flex and bend such that a downwash angle of the drilling fluid may change below the at least one flow guide 205B. The flexible vanes 306B of the flow guide 205B may also restrict the rotational movement of the plate 301B.

Figure 4A:
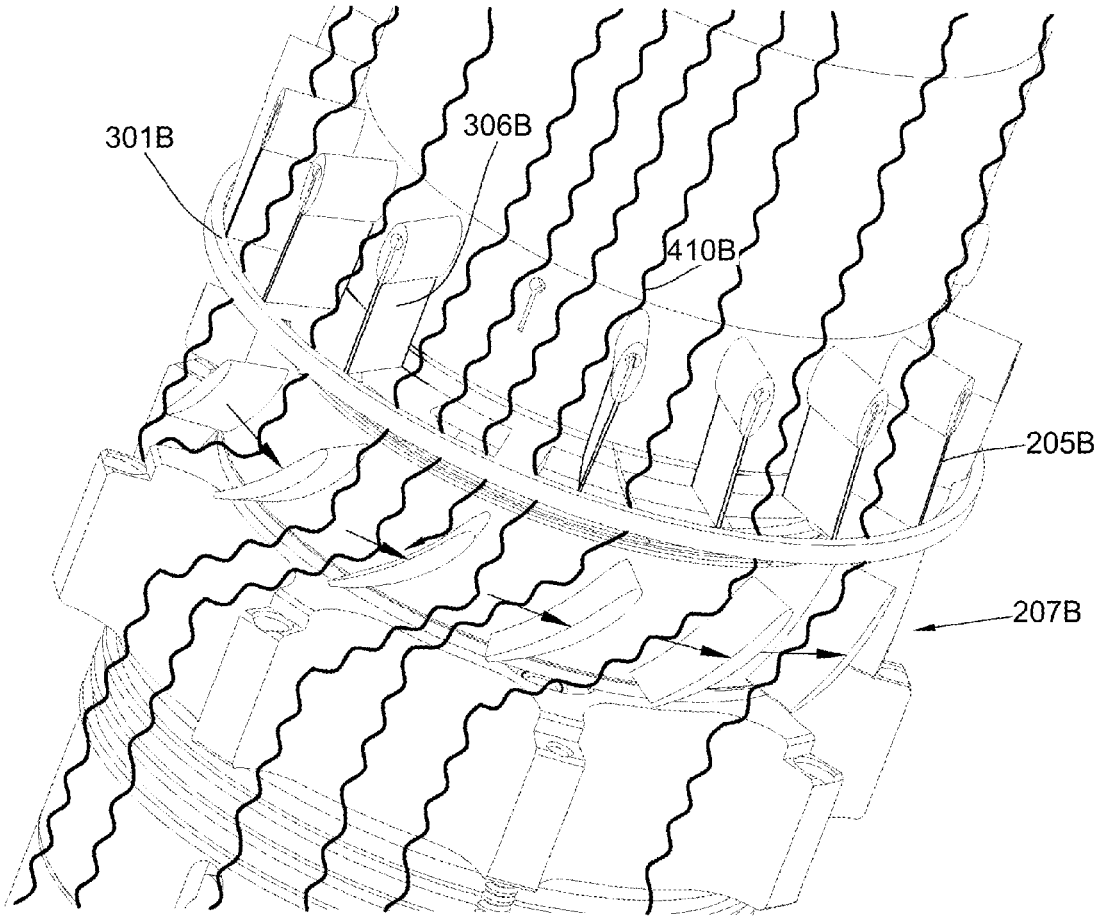
FIG. 4*a* is another perspective diagram of an embodiment of a turbine, flow guide, and actuator.
Figure 4B:
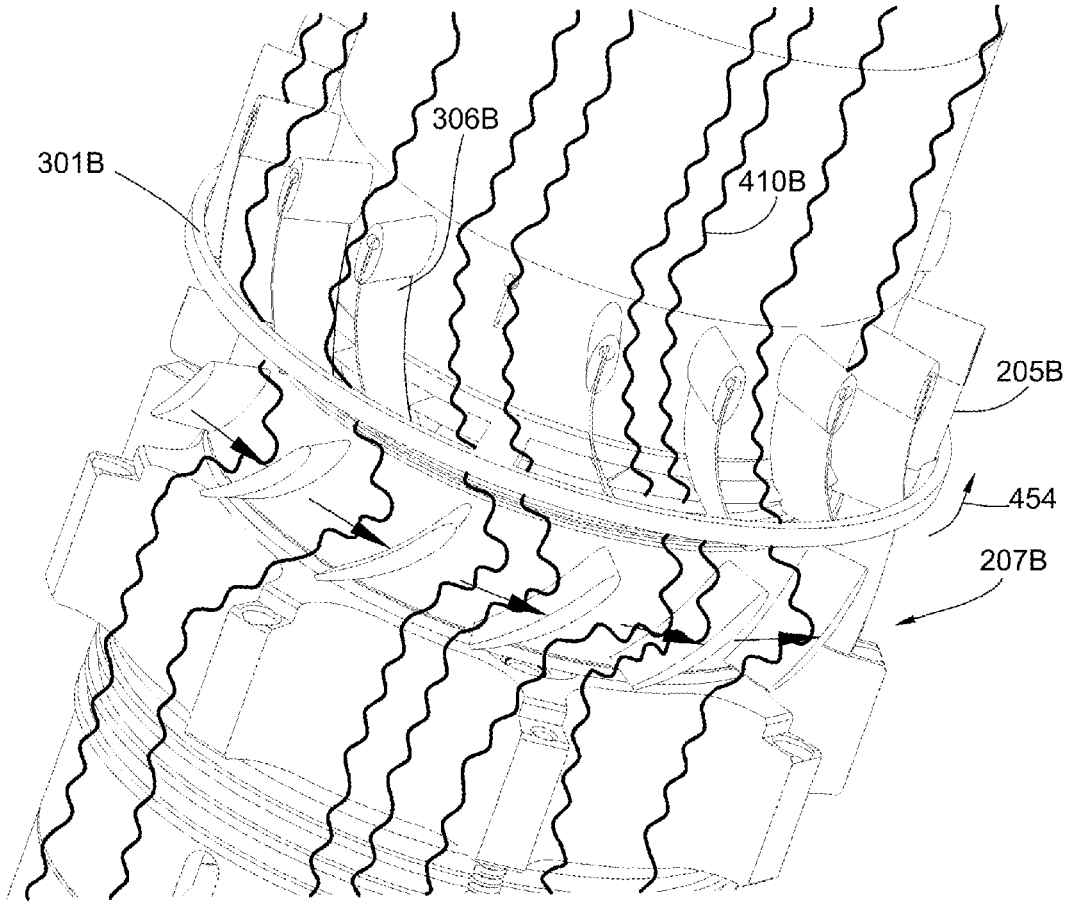
FIG. 4*b* is another perspective diagram of an embodiment of a turbine, flow guide, and actuator.

FIGS. 4*a* and 4*b* illustrate the portion of an embodiment of a drilling assembly 103B of FIG. 3 and depict the flexible vanes 306B in various positions. In this embodiment, drilling fluid 410B is depicted flowing down the drill string and engaging the turbine 207B. Adjusting the flexible vanes 306B by rotating 454 the plate 301B flexes the flexible vanes 306B and changes the downwash angle that the drilling fluid 410B will engage the turbine 207. Changing the downwash angle causes the turbine 207B to travel at different speeds based upon the rotation 454 of the plate 301B. This method is used to slow down or speed up the turbine 207B or to increase or decrease the torque from the turbine 207. FIG. 4*a* depicts the plate 301A having no torque applied to it. In this orientation the vanes 306B are not flexed or bent. The drilling fluid 410 may flow past the vanes 306B nearly uninterrupted. The drilling fluid 410B may go on to exert a force on the turbine 207B by generating lift as it passes the turbine 207B. In FIG. 4*b* the plate 301B has a torque applied to it rotating the plate such that the vanes 306B are flexed. The flexed vanes 306B change the downwash angle of the drilling fluid 410B. The drilling fluid 410B engages the turbine 207B at an angle. The turbine 207B turns faster in this case due to increased lift than it would in the case depicted in FIG. 4*a*.

Figure 5:
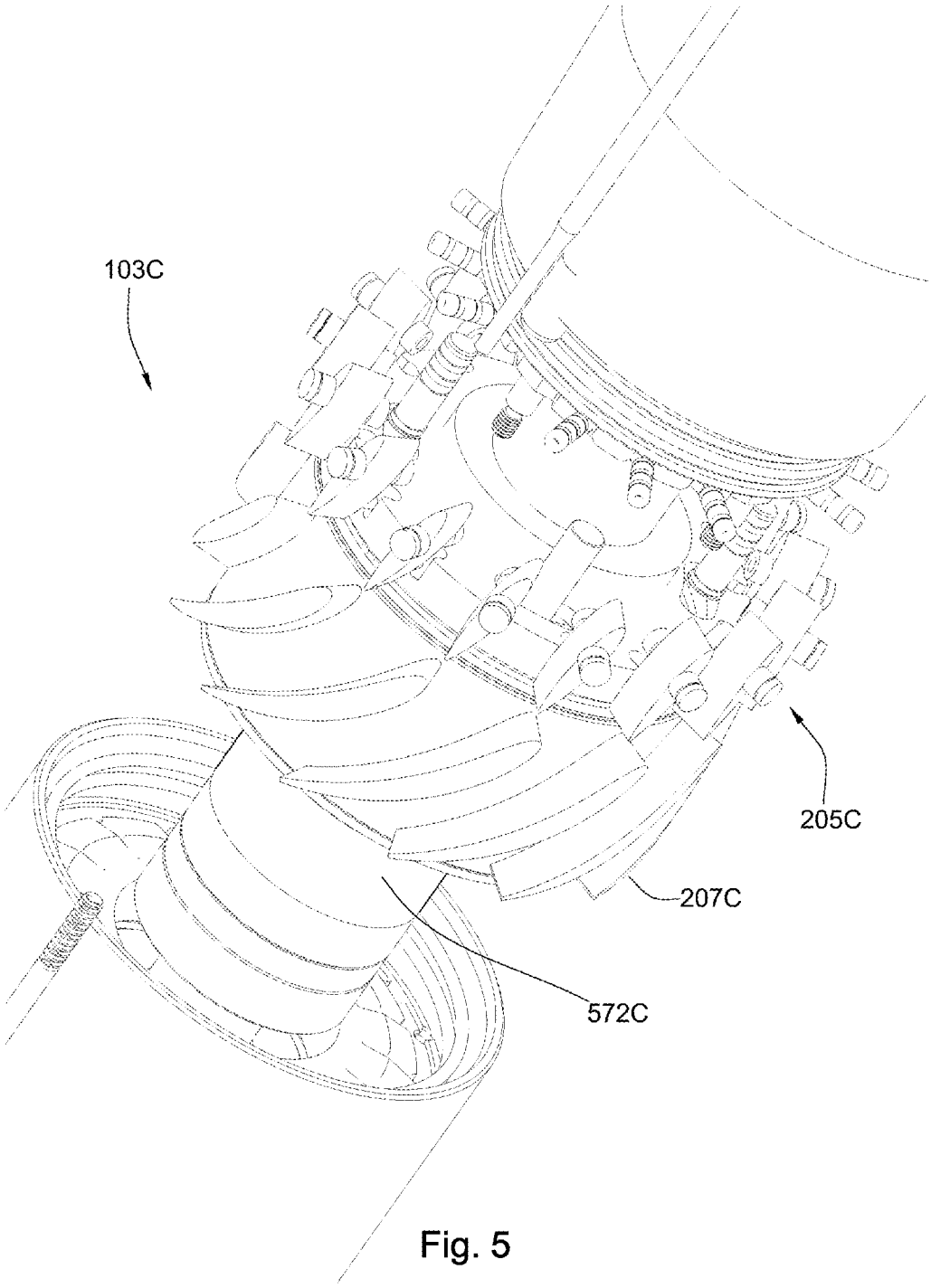
FIG. 5 is another perspective diagram of an embodiment of a turbine, flow guide, and actuator.

FIG. 5 depicts a diagram of a portion of an embodiment of a drilling assembly 103C comprising at least one flow guide 205C, a turbine 207C, and a generator 572C. In this embodiment the rotation of the turbine 207C actuates the generator 572C creating electrical power. The at least one flow guide 205C may be controlled by a feedback loop that is driven by the output voltage of the generator 572C. In one embodiment, the feedback loop positions the at least one flow guide 205C in such a way as to prevent the generator 572C from creating either too little power or too much power. Excess power created by the generator 572C may turn into heat which can adversely affect downhole instruments and too little power may prevent downhole instruments from operating.

In another embodiment, the positioning of the at least one flow guide 205C is set by an uphole user. An uphole user may to set the position of the at least one flow guide 205C based upon a flow rate of drilling fluid entering the drilling assembly 103C, based upon a desired power output, or based upon some other desired parameter.

Figure 6:
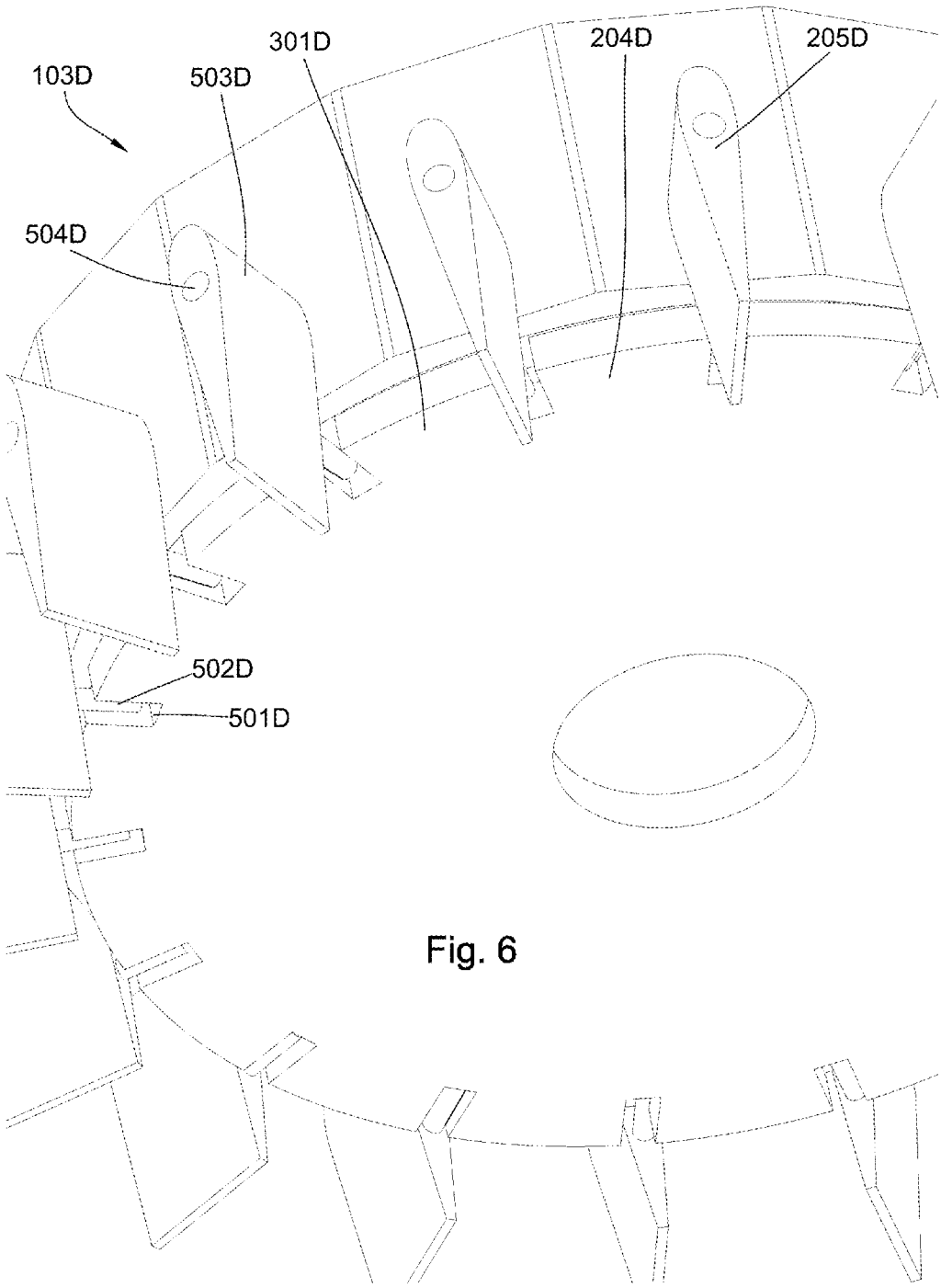
FIG. 6 is a perspective diagram of an embodiment of a flow guide and actuator.

FIG. 6 depicts a portion of an embodiment of a drilling assembly 103D having an actuator 204D and at least one flow guide 205D. In this this embodiment the at least one flow guide 205D is a rigid fin 503D. The fin 503D attaches to the drill string through a pivot point 504D. The actuator 204D in this embodiment is a plate 301D with slots 501D disposed around its circumference. The slots 501D are adapted to receive tabs 502D disposed on the fins 503D. The actuator 204D controls the fins 503D by rotating the plate 301D such that the tabs 502D engaged within the slots 501 cause the fins 503D to rotate on their pivot point 504D. The rotated fins 503D cause drilling fluid to change the angle at which it engages a turbine (not shown).

Figure 7:
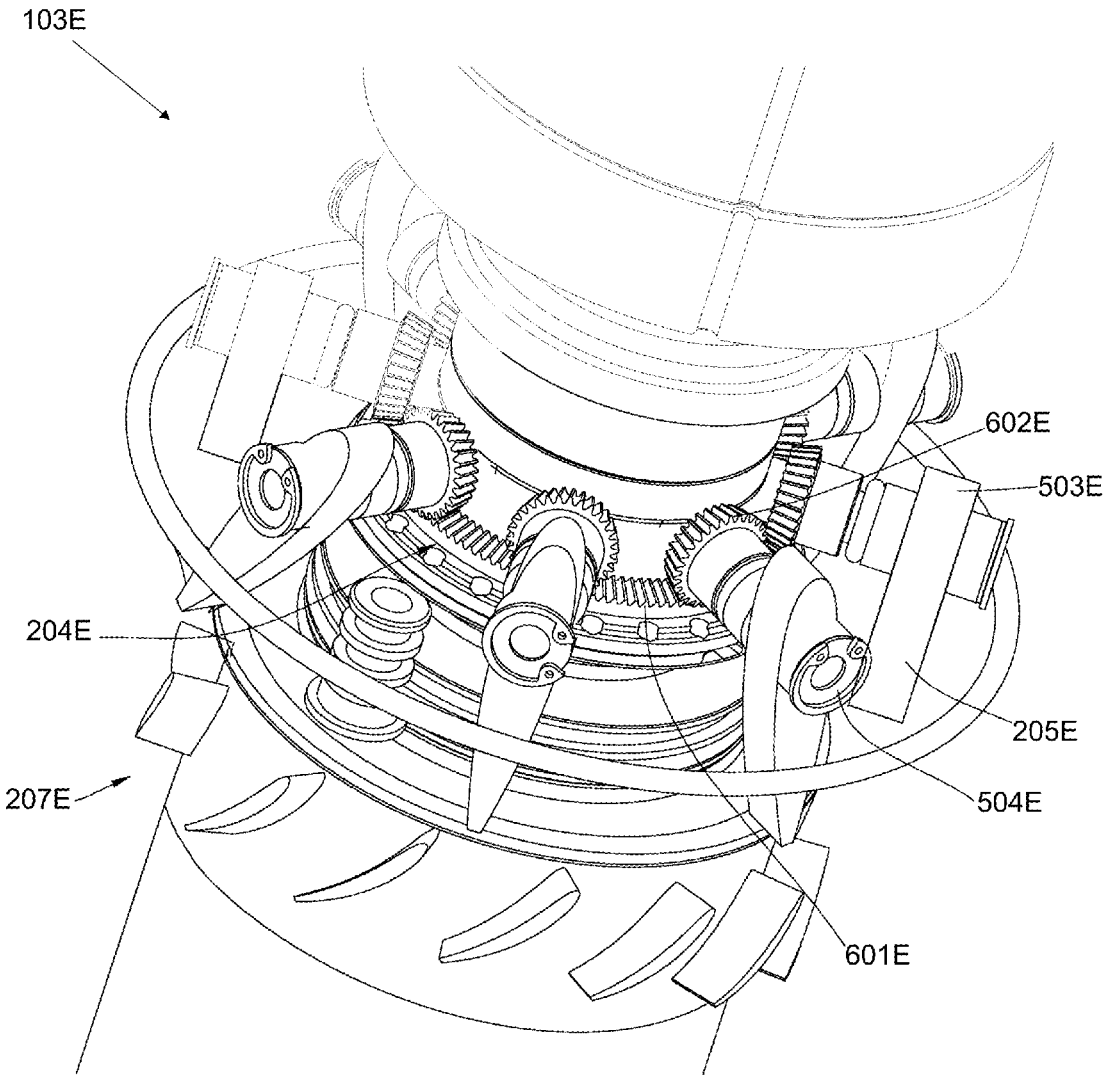
FIG. 7 is another perspective diagram of an embodiment of a turbine, flow guide, and actuator.

FIG. 7 is a diagram of an embodiment an embodiment of a drilling assembly 103E having a turbine 207E, an actuator 204E, and at least one flow guide 205E. The flow guides 205E in the embodiment of FIG. 7 are fins 503. In this embodiment the actuator 204E comprises a rack 601E and pinion 602E. The rotation of the rack 601E causes the fins 503E to rotate around a pivot point 504E. The rotated fins 503E change the angle at which drilling fluid engages the turbine 207E thereby changing the rotational speed of the turbine 207E.

Figure 8:
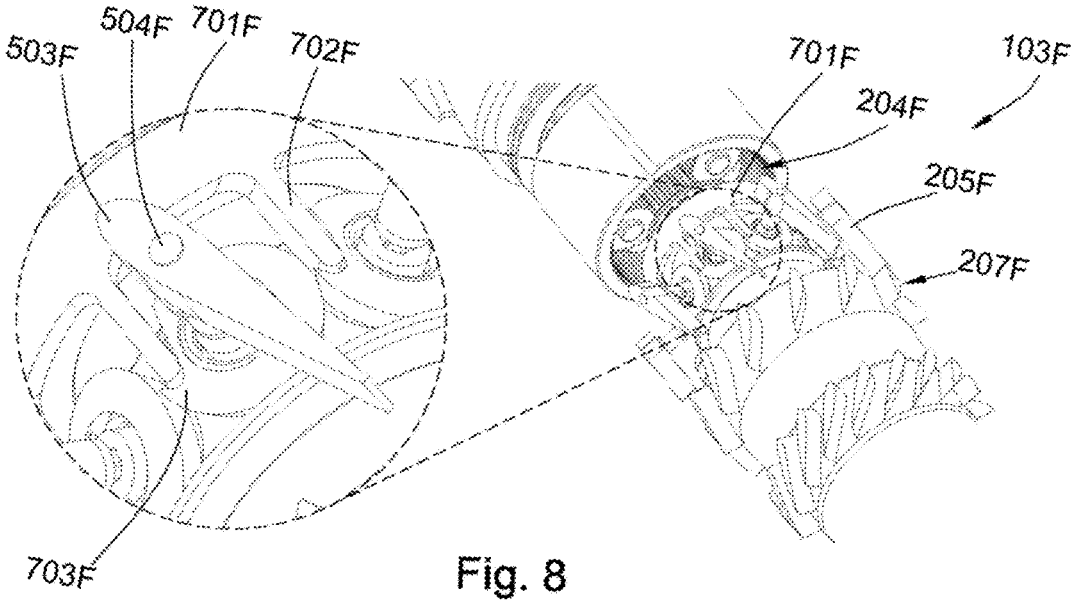
FIG. 8 is another perspective diagram of an embodiment of a turbine, flow guide, and actuator.

FIG. 8 is a depiction of another embodiment of a drilling assembly 103F having a turbine 207F, an actuator 204F and at least one flow guide 205F. In this embodiment the actuator 204F is a slider 701F. The slider 701F is disposed radially around a central axis of the drilling assembly 103F. The actuator 204F includes a motor, a pump, a piston, at least one gear, or a combination thereof, adapted to move the slider 701F parallel to the central axis of the drilling assembly 103F. The slider 701F has at least one flange 702F. The flow guide 205F is a fin 503F connected to the drill string at a pivot point 504F. The flow guide 205F further includes a lip 703F. The flange 702F of the slider 701F is adapted to fit on the lip 703F of the flow guide 205F. As the slider 701F moves towards the flow guide 205F the flange 702F exerts a force on the lip 703F causing the fins 503F to rotate. The rotated fins 503F change the angle at which drilling fluid engages the turbine 207F, generating additional lift, and changing the rotational speed of the turbine 207F.

Figure 9:
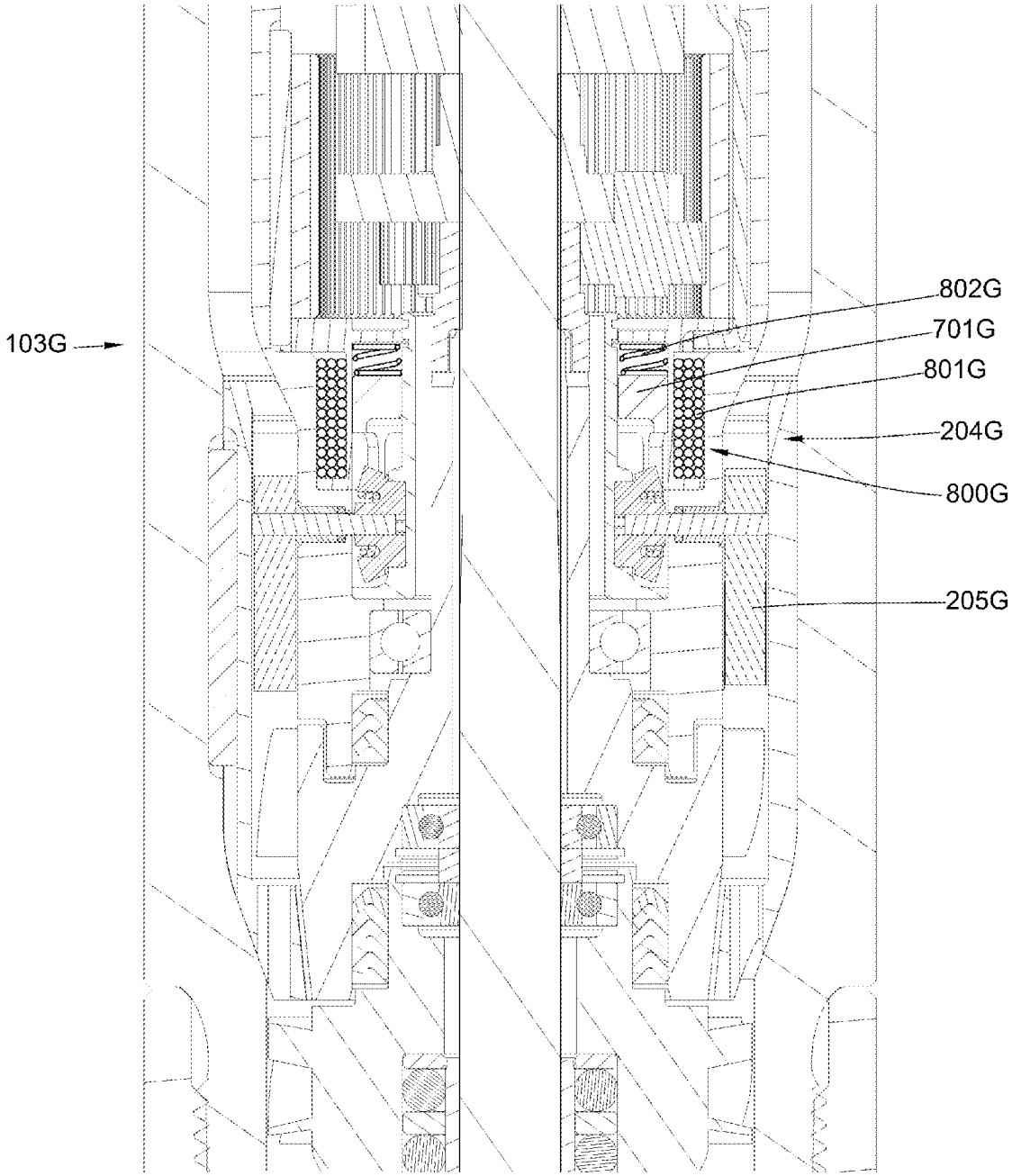
FIG. 9 is a cross-sectional diagram of an embodiment of a turbine, flow guide, and actuator.

FIG. 9 is a cross-sectional diagram depicting an embodiment of a drilling assembly 103G. In this embodiment the actuator 204G includes a solenoid valve 800G. The solenoid valve 800G includes a coil of wire 801G wrapped circumferentially around a central axis of the drilling assembly 103G. When the coil of wire 801G is electrically excited, a slider 701G is displaced such that a flow guide 205G is actuated. A preloaded torsion spring 802G may then return the flow guide 205G to an original position after the solenoid valve 800G disengages.

Figure 10A:
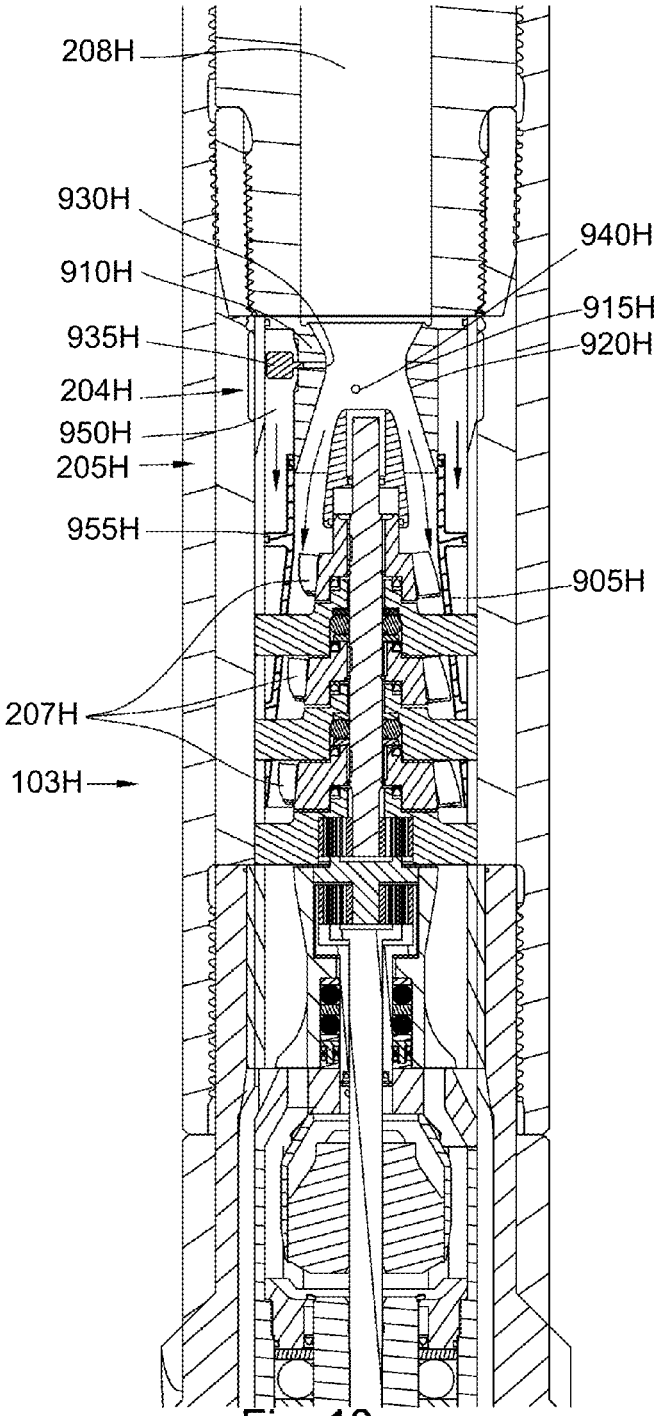
FIG. 10*a* is another cross-sectional diagram of an embodiment of a turbine, flow guide, and actuator.
Figure 10B:
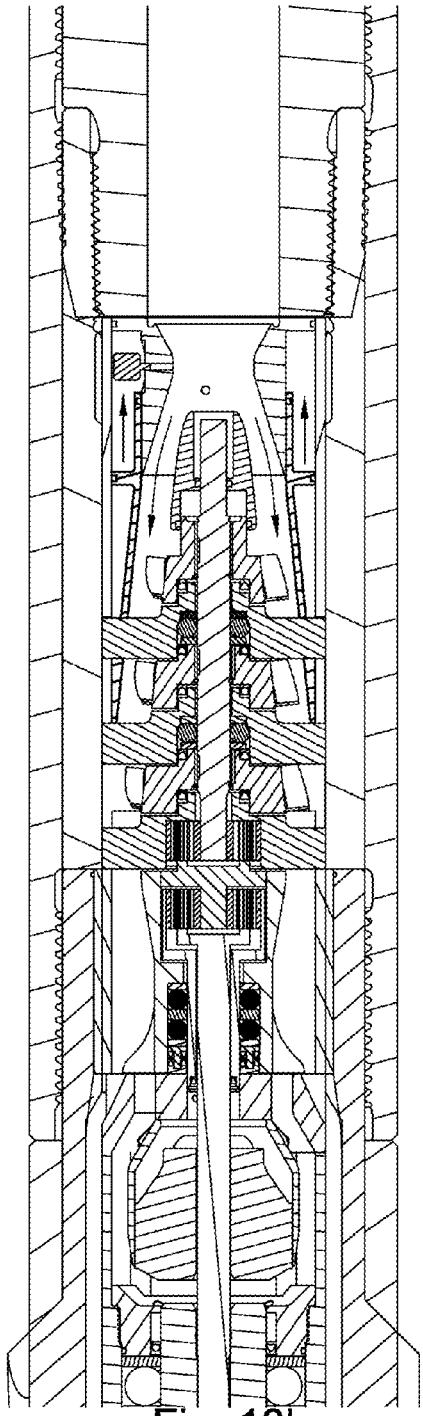
FIG. 10*b* is another cross-sectional diagram of an embodiment of a turbine, flow guide, and actuator.

FIGS. 10*a* and 10*b* depict another embodiment of a drilling assembly 103H having a turbine 207H, an actuator 204H, and a flow guide 205H. The drill string assembly 103H has a plurality of turbines 207H. In this embodiment, the flow guide 205H is a funnel 905H. As the funnel 905H is axially translated it alters the flow space across the turbines 207H. As the funnel 905H restricts the flow space across the turbines 207H the drilling fluid velocity increases thus increasing the rotational speed of the turbines 207H.

The funnel 905H may be axially translated by means of a Venturi tube 910H. The Venturi tube 910H has at least one constricted section 915H of higher velocity and lower pressure drilling fluid and at least one wider section 920H of lower velocity and higher pressure drilling fluid. The Venturi tube 910H also has at least one low pressure aspirator 930H and at least one high pressure aspirator 940H. The at least one low pressure aspirator 930H that may be opened by at least one low pressure valve 935H and the at least one high pressure aspirator 940H may be opened by at least one high pressure valve (not shown). When the high pressure aspirator 940H is opened and the low pressure aspirator 930H is closed, the drilling fluid flows from the bore 208H to a chamber 950H. A piston element 955H attached to the funnel 905H and slidably housed within the chamber 950H forms a pressure cavity. As drilling fluid flows into the chamber 950H, the pressure cavity expands axially translating the funnel 905H. (See FIG. 10*a*) If the low pressure aspirator 930H is opened and the high pressure aspirator 940H is closed, the drilling fluid flows from the pressure chamber 950H to the bore 208H. As drilling fluid flows out of the chamber 950H the pressure cavity contracts reversing the axial translation of the funnel 905H. (See FIG. 10*b*)

Figure 11:
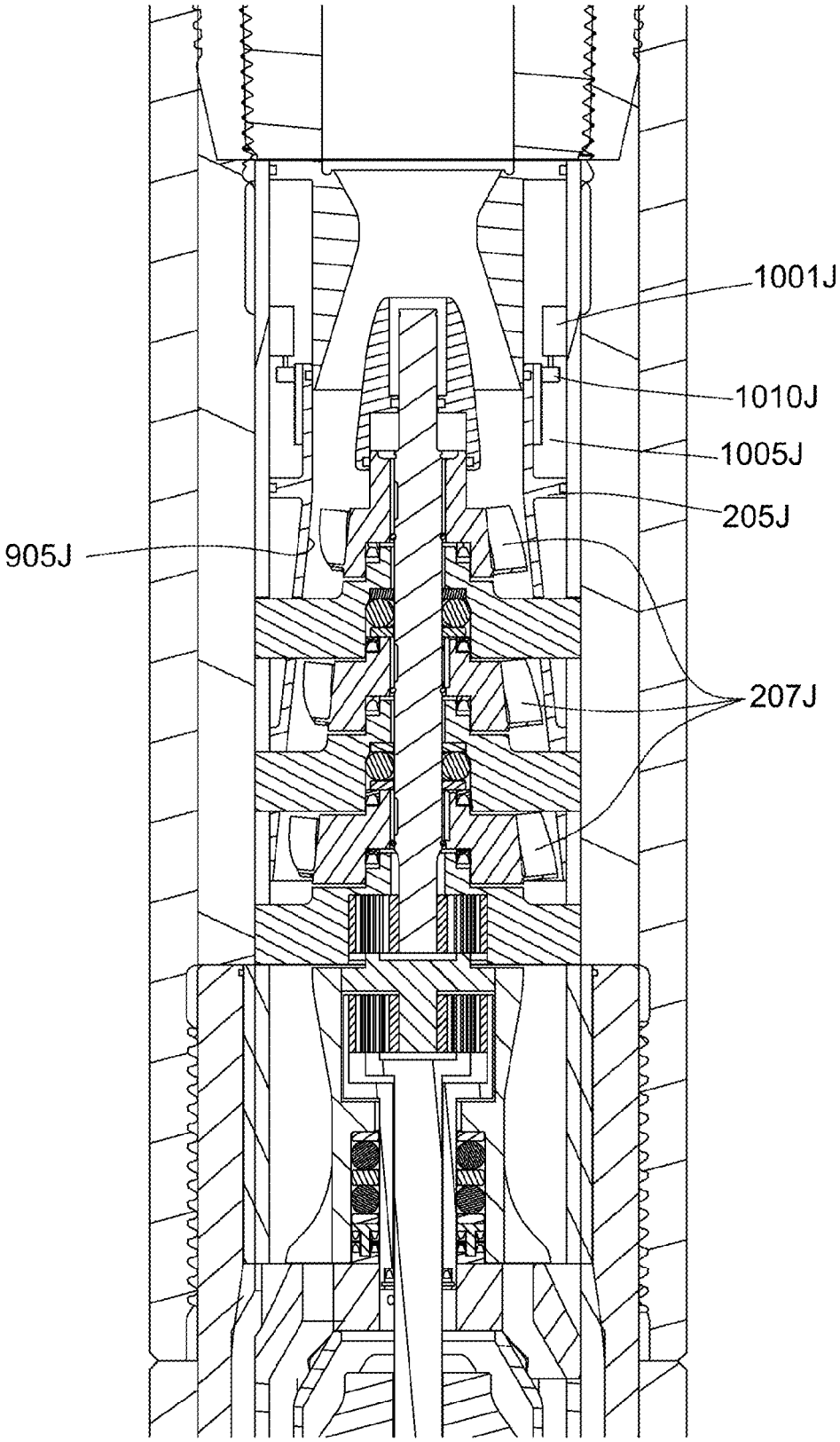
FIG. 11 is another cross-sectional diagram of an embodiment of a turbine, flow guide, and actuator.

FIG. 11 illustrates an embodiment of a flow guide 205J in the form of a funnel 905J. In this embodiment the funnel 905J may be axially translated by means of at least one motor 1001J. The motor 1001J is in communication with a rack 1005J and pinion 1010J. The rack 1005J is connected to the funnel 905J and the pinion 1010J is a worm gear. As the pinion 1010J is rotated by the motor 1001J, the rack 1005J and funnel 905J are axially translated.

Figure 12A:
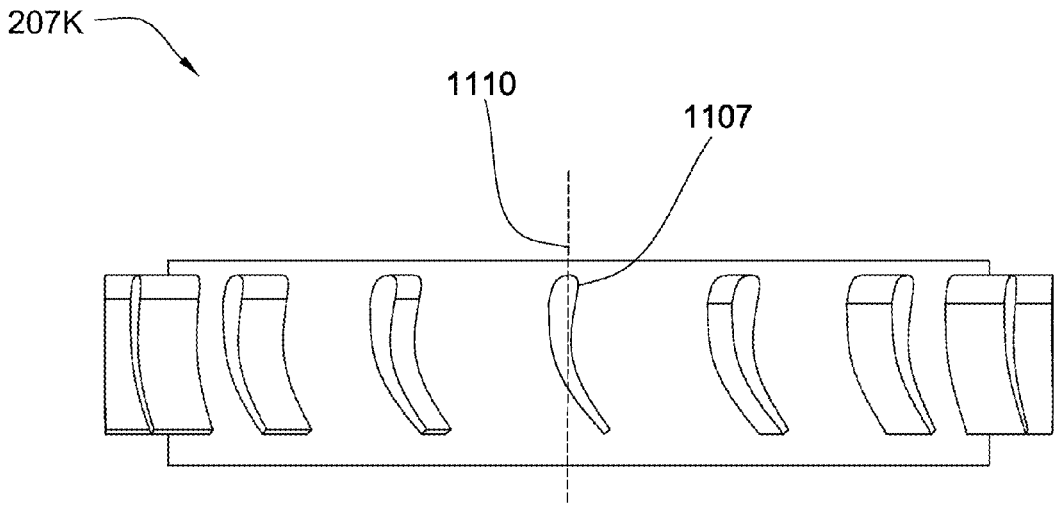
FIGS. 12*a* and 12*b* are side view diagrams of an embodiment of a turbine comprising dynamic turbine blades.
Figure 12B:
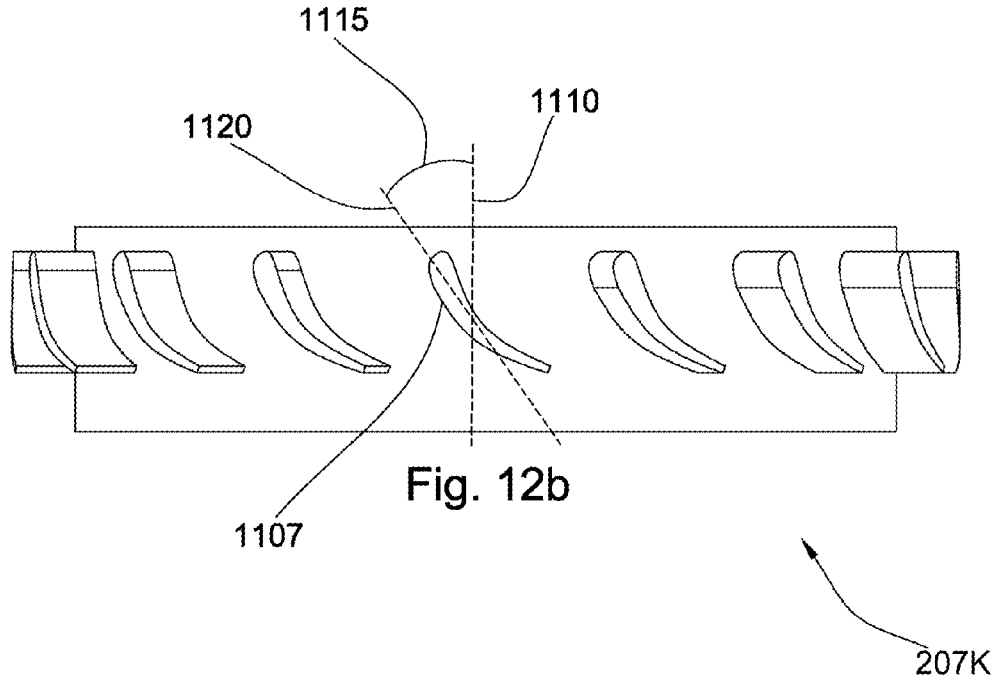

FIGS. 12*a* and 12*b* illustrate an embodiment of a turbine 207K having at least one turbine blade 1107. The turbine blade 1107 is aligned along an initial vector 1110. The turbine blade 1107 may rotate a given angle 1115 to a subsequent vector 1120. The given angle 1115 may remain the same for several rotations of the turbine blade 1107 or the given angle 1115 may vary for different rotations. Rotation of the turbine blade 1107 from the initial vector 1110 to the subsequent vector 1120 may alter the rotational speed of the turbine 207K.

Whereas the present invention has been described in particular relation to the drawings attached hereto, it should be understood that other and further modifications apart from those shown or suggested herein, may be made within the scope and spirit of the present invention.

What is claimed is:

1. A downhole drill string assembly comprising:

a cylindrical body having a longitudinal bore adapted to receive a drilling fluid;

a fluid within said longitudinal bore;

a turbine disposed within said longitudinal bore and in fluid communication with said longitudinal bore, said turbine having at least one fixed blade adapted to rotate said turbine in response to a flow of said drilling fluid;

at least one flow guide disposed within said longitudinal bore upstream of said turbine and in fluid communication with said longitudinal bore, said at least one flow guide having at least one adjustable vane having an orientation, said orientation adapted to alter said flow of said drilling fluid proximate said turbine;

an actuator in mechanical communication with said at least one flow guide, said actuator adapted to selectively alter said orientation of said at least one adjustable vane; and a jack element disposed within the downhole drill string assembly, the jack element having an actuation coupled to the rotation of the turbine.

2. The downhole drill string assembly of claim 1, wherein said flow guide is adapted to cause said flow of said drilling fluid to pass over said at least one turbine blade at an attack angle and wherein said flow guide is adapted to selectively alter said attack angle based on said orientation of at least one adjustable vane.

3. The downhole drill string assembly of claim 2, wherein altering said attack angle alters a rotational speed of said turbine and a frequency of actuation of the jack element.

4. The downhole drill string assembly of claim 1, wherein said at least one adjustable vane is flexible and said at least one adjustable vane flexes to redirect said flow of said drilling fluid.

5. The downhole drill string assembly of claim 4, wherein said at least one adjustable vane has a leading edge and a trailing edge, wherein said leading edge is fixed and said trailing edge is adapted to be flexed by said actuator.

6. The downhole drill string assembly of claim 5, wherein said actuator is a rotational plate that flexes said trailing edge of said at least one adjustable vane by rotating around a central axis of said drill string assembly.

7. The downhole drill string assembly of claim 1, wherein said at least one adjustable vane is a rotating fin that rotates to redirect said flow of said drilling fluid.

8. The downhole drill string assembly of claim 7, wherein said rotating fin has a pivot point and said actuator is a rotational plate that rotates said rotating fin around said pivot point.

9. The downhole drill string assembly of claim 8, wherein said rotating fin has a tab, said rotational plate has at least one slot, and said rotational plate is adapted to rotate said fin by engaging said tab within said at least one slot.

10. The downhole drill string assembly of claim 7, wherein said rotating fin has a pivot point and said actuator has a system of gears adapted to rotate said fin at said pivot point.

11. The downhole drill string assembly of claim 10, wherein said system of gears is a rack and pinion, wherein said pinion is attached to said pivot point and said rack rotates around a central axis of said drill string assembly.

12. The downhole drill string assembly of claim 7, wherein said rotating fin has a pivot point and a lip, and wherein said actuator has a slider and a flange, said slider adapted to slide said flange parallel to a central axis of said drill string assembly, wherein said flange is adapted to exert a force on said lip to rotate said fin.

13. The downhole drill string assembly of claim 12, wherein said slider is slid by a motor, a pump, a piston, a solenoid, or at least one gear.

14. The downhole drill string assembly of claim 1, wherein said turbine is attached to a generator adapted to convert a rotational energy of said turbine into electrical energy.

15. The downhole drill string assembly of claim 14, wherein a computer processing unit is attached to said generator and said computer processing unit is adapted to control said actuator.

16. A downhole drill string assembly comprising:

a cylindrical body having a longitudinal bore adapted to receive a drilling fluid;

a fluid disposed within said longitudinal bore;

a turbine disposed within said longitudinal bore and in fluid communication with said longitudinal bore, said turbine having at least one fixed blade adapted to rotate said turbine in response to a flow of said drilling fluid flowing past the turbine;

a flow guide disposed within said longitudinal bore and in fluid communication with said longitudinal bore, said flow guide having an internal surface defining a flow space between the turbine and the flow guide, and wherein the flow guide is adapted to selectively alter a cross sectional area of said flow space.

17. The downhole drill string assembly of claim 16, further comprising an actuator in communication with said flow guide and adapted to move said flow guide in a longitudinal direction to alter said cross sectional area.

* * * * *